US012123298B1

(12) United States Patent
Bland et al.

(10) Patent No.: US 12,123,298 B1
(45) Date of Patent: Oct. 22, 2024

(54) DETERMINING CLUSTER LEVEL UNIFORMITY INDEX IN HYDRAULIC FRACTURING WELLS

(71) Applicant: Halliburton Energy Services, Inc., Houston, TX (US)

(72) Inventors: Henry Bland, Calgary (CA); Mikko K. Jaaskelainen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/229,453

(22) Filed: Aug. 2, 2023

(51) Int. Cl.

| | |
|---|---|
| ***E21B 47/107*** | (2012.01) |
| ***E21B 43/119*** | (2006.01) |
| ***E21B 43/26*** | (2006.01) |
| ***E21B 47/135*** | (2012.01) |
| ***E21B 47/18*** | (2012.01) |

(52) U.S. Cl.
CPC ..... *E21B 47/107* (2020.05); *E21B 43/119* (2013.01); *E21B 43/26* (2013.01); *E21B 47/135* (2020.05); *E21B 47/18* (2013.01); *E21B 2200/20* (2020.05)

(58) Field of Classification Search
CPC ..... E21B 47/107; E21B 43/119; E21B 43/26; E21B 47/135; E21B 47/18; E21B 2200/20
See application file for complete search history.

(56) References Cited

U.S. PATENT DOCUMENTS

| | | | | |
|---|---|---|---|---|
| 11,396,808 | B2 | 7/2022 | Jaaskelainen et al. | |
| 11,487,037 | B2 | 11/2022 | Therrien et al. | |
| 11,560,792 | B2 | 1/2023 | Zhang et al. | |
| 11,768,307 | B2 * | 9/2023 | Jin | E21B 47/14 702/6 |
| 2018/0210105 | A1 * | 7/2018 | Stokely | G01H 9/004 |
| 2021/0301652 | A1 * | 9/2021 | Zhang | E21B 43/26 |
| 2022/0186614 | A1 * | 6/2022 | Henao | E21B 43/26 |
| 2022/0228484 | A1 * | 7/2022 | Cramer | E21B 43/116 |
| 2023/0025091 | A1 * | 1/2023 | Thompson | G01V 1/301 |
| 2023/0124730 | A1 * | 4/2023 | Zheng | G01V 1/226 702/14 |
| 2023/0147476 | A1 * | 5/2023 | Wheelock | E21B 47/26 367/82 |

* cited by examiner

*Primary Examiner* — James G Sayre
(74) *Attorney, Agent, or Firm* — Kilpatrick Townsend & Stockton LLP

(57) ABSTRACT

A system for evaluating the flow of pressurized fluid flowing through perforation clusters in a wellbore casing of a hydraulic fracturing wellbore. The system can temporarily increase an intensity of acoustic emissions produced by the pressurized fluid flowing through the perforation clusters and can employ an optical fiber-based acoustic sensing system disposed on or in a monitoring well residing in the formation but remotely from the hydraulic fracturing well to measure the acoustic emissions while the intensity of the acoustic emissions is temporarily increased. The measured acoustic emissions can be converted into a total flow rate of the pressurized fluid flowing through the perforation clusters, which can in turn be used to calculate a cluster level uniformity index for the hydraulic fracturing well.

20 Claims, 5 Drawing Sheets

DETERMINING CLUSTER LEVEL UNIFORMITY INDEX IN HYDRAULIC FRACTURING WELLS

TECHNICAL FIELD

The present disclosure relates generally to hydrocarbon well operations, and more particularly although not necessarily exclusively, to evaluating fluid flow through perforation clusters of a hydraulic fracturing well.

BACKGROUND

Attempted methods for evaluating the perforation cluster performance of hydraulic fracturing wells have included, among other techniques, acoustic sensing using an optical fiber cable cemented to the outside of a hydraulic fracturing well casing or to the outside of a monitoring well casing, or deploying an optical fiber within a hydraulic fracturing well casing. Traditional (permanent) optical fiber cable is costly, requires additional labor for deployment, additional materials such as clamps, etc., to secure the optical fiber cable to the well casing, and presents scheduling challenges. Further, when associated with a hydraulic fracturing well, the optical fiber cable may be damaged during a run-in-hole (RIH) operation or during a casing perforation operation. Disposable optical fiber cable, which is deployed inside a casing, is less costly than traditional optical fiber cable. However, disposable optical fiber cable cannot be used in hydraulic fracturing wells, at least at the treatment stage, as the fluid flow rate and/or the proppant entrained in the treatment fluid will degrade and break the optical fiber cable.

Optical fiber cable, such as disposable optical fiber cable, may be more protected when secured to or located in a monitoring well casing. Unfortunately, monitoring wells are in many cases separated by long distances (e.g., thousands of feet) from a hydraulic fracturing well of interest. This distance results in any detectable emissions (from the perforation clusters) having a low signal strength at the location of the monitoring well. This has generally prevented the use of optical fiber cable-based acoustic sensing techniques associated with monitoring wells unusable for accurate assessment of hydraulic fracturing well perforation cluster performance.

DETAILED DESCRIPTION

Figure 1:
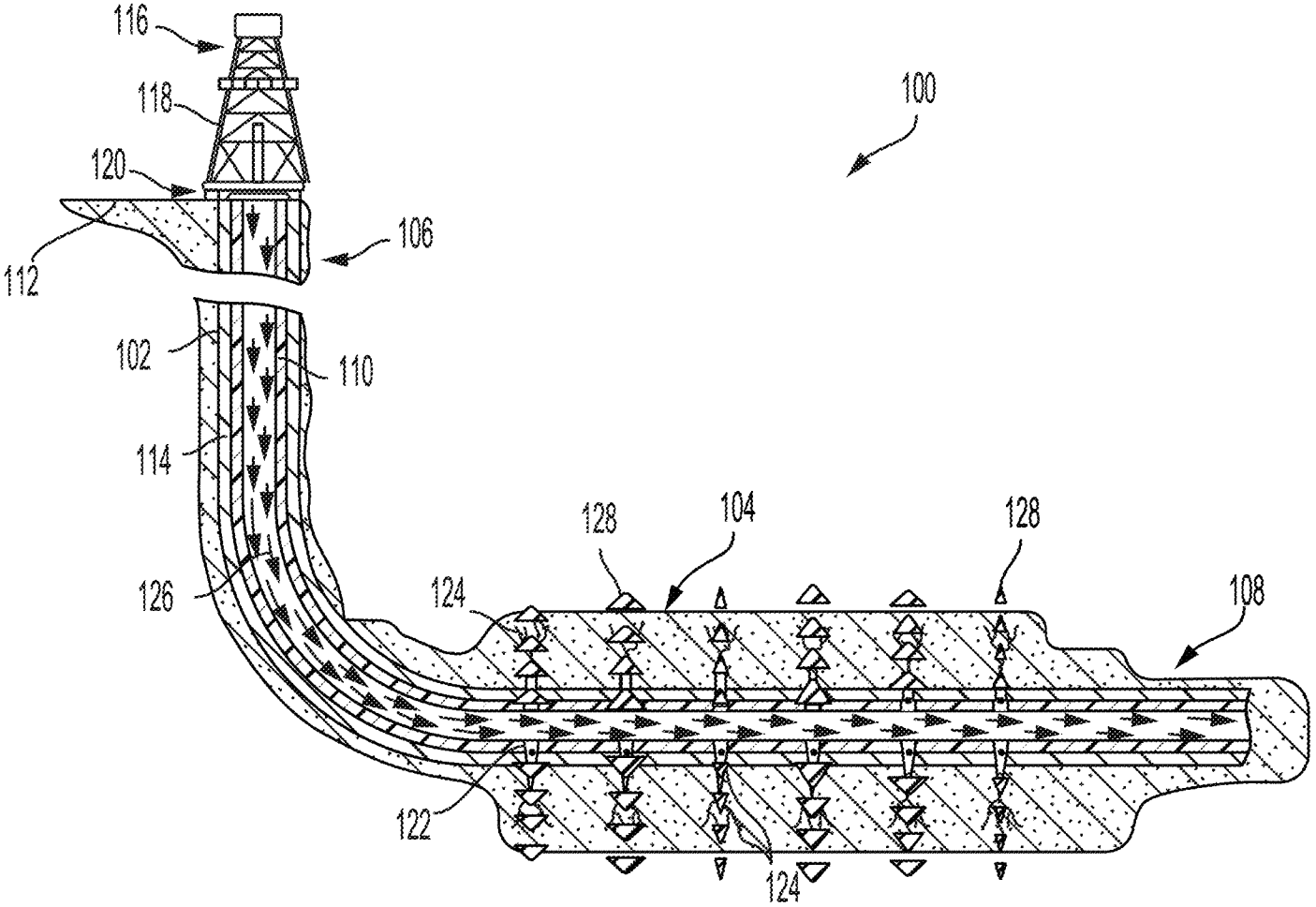
FIG. 1 is a schematic diagram of a hydraulic fracturing well according to one example of the present disclosure.

Certain aspects and examples of the present disclosure relate to a system for evaluating the flow of pressurized treatment fluid through perforation clusters in a wellbore casing of a hydraulic fracturing well. As would be well understood by one of skill in the art, hydraulic fracturing (i.e., "fracking") is a process used in the oil and gas industry to extract hydrocarbons from deep within underground formations that may have various subsurface properties. After drilling a wellbore, which typically includes a horizontally-oriented portion, a steel casing is inserted into the wellbore and cemented in place during well completion, whereafter the casing (and the cement surrounding the casing) is perforated in multiple locations by a perforating gun or by another technique for creating openings (perforations) through which treatment fluid can flow outward from the wellbore in the treatment well stage to create fractures in the formation. Each perforation location normally includes multiple perforations. These groupings of perforations are commonly referred to as perforation clusters.

Prior to placing the well into production, fracturing of the formation is accomplished by injecting a treatment fluid, typically a staged mixture of water, chemicals, and proppant (e.g., sand), into the wellbore under high pressure such that the treatment fluid will flow forcibly outward through the casing perforation clusters to create small fractures in the surrounding formation. The subsurface properties of a given formation can vary depending on the location of the formation. Thus, the performance of a particular arrangement and quantity of perforation clusters in one formation may not translate perfectly to another formation. This results in a need to monitor and evaluate each fracturing operation to ensure that a given formation is being adequately fractured prior to placing a completed well into production.

Understanding the flow rate and the uniformity of the flow of treatment fluid through various perforation clusters present in the casing of a hydraulic fracturing wellbore can allow a hydraulic fracturing well operator to appraise how effectively a given well stage and completion design is performing. Knowledge of the flow rate and the uniformity of the flow of treatment fluid through various perforation clusters can be used by the well operator to assess the likelihood that pressurized treatment fluid is sufficiently fracturing the formation surrounding the wellbore. Knowledge of the flow rate and the uniformity of the flow of treatment fluid through various perforation clusters can also be used by the well operator to, for example, alter the pattern, quantity, or frequency of perforation clusters as required to produce a desired level of treatment fluid flow through the wellbore casing and into the formation.

A system for evaluating the performance of perforation clusters in a hydraulic fracturing (treatment) well according to an example of the present disclosure can operate by evaluating, from a monitoring well location, the flow of pressurized fluid through the perforation clusters of the hydraulic fracturing well and determining a fluid flow allocation for each perforation cluster of the treatment well (i.e., the cluster level uniformity index). A system according to an example of the present disclosure may include a distributed acoustic sensing (DAS) system associated with one or more monitoring wells, coupled with a mechanism for temporarily increasing the intensity of acoustic emissions produced by the pressurized fluid at the perforation clusters of the treatment well by introducing a pressure pulse into the treatment well, or by temporarily modifying or replacing the pressurized treatment fluid in the treatment well to reduce an enthalpy of vaporization of the pressurized fluid passing through the perforation clusters. The increase in the intensity of the acoustic emissions resulting from introduction of the pressure pulse and/or the reduction in the enthalpy of vaporization of the pressurized fluid makes it possible to accurately measure the flow of the pressurized fluid as it passes through the perforation clusters of the treatment well, even though the monitoring well(s) associated with the DAS system being used to make such measurements may reside a considerable distance (e.g., thousands of feet) away from the treatment well.

A cluster level uniformity index determination based on treatment well fluid flow emission measurements collected by a system according to examples of the present disclosure can be used for a number of purposes and may cause initiation of various actions. For example, the system may generate a report or otherwise indicate the status of fluid outflow and cluster level uniformity index, such as to personnel responsible for designing or installing the treatment well completion and the associated perforation clusters. A system according to the present disclosure may also, in response to determining that the fluid outflow from, or the cluster level uniformity index of, a given treatment well completion is unacceptable, initiate a change in a characteristic of the current treatment operation for a given stage design and/or subsequently created perforation clusters during future stages such as by outputting a control command to a perforation gun or another perforation creation device located in the wellbore casing of the treatment well. The perforation cluster characteristic of future stages may be, for example and without limitation, one or more of perforation placement, quantity, frequency, etc. Changes to the current treatment operation may include modifying flow rates, pressures, chemical compositions and/or concentration, proppant concentration, or the addition of diverter materials with the intent of altering the flow distribution between clusters. Changes to the current treatment operation may be automatic real-time changes or changes that are recommended to an onsite or offsite operator such that the operator can take action to alter the treatment operation.

Illustrative examples follow, and are given to introduce the reader to the general subject matter discussed herein rather than to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

One example of a treatment stage hydraulic fracturing well 100 is represented in the diagram of FIG. 1. As shown, the hydraulic fracturing well 100 can include a wellbore 102 that is formed in a subterranean formation 104, but may alternatively be formed in a sub-oceanic formation. The hydraulic fracturing well 100 can include a vertical wellbore portion 106 and a horizontal wellbore portion 108. The hydraulic fracturing well 100 may include a wellbore casing 110 for transporting produced fluid from the formation 104 to the surface 112 once the hydraulic fracturing well 100 is completed. The wellbore casing 110 may be cemented into the wellbore 102 by introducing cement 114 into the annular space between the wellbore 102 and wellbore casing 110, as would be familiar to one of skill in the art.

As represented in the particular example of FIG. 1, a drilling rig 116 including a derrick 118 that resides on a rig floor 120 is used to drill the wellbore 102 and to subsequently install the wellbore casing 110 as a part of the hydraulic fracturing well 100 completion process. As part of the completion process, multiple perforation clusters 122 are produced at intervals through the wellbore casing 110 of the horizontal wellbore portion 108. It is also possible in other examples for perforation clusters to be produced at intervals through the wellbore casing 110 of the vertical wellbore portion 106. The perforation clusters 122, which are typically produced in one stage of the wellbore casing 110 at a time as the casing is installed to the wellbore 102, may be created by a perforation gun or by any other technique known in the art. A person skilled in the art will readily understand that a given well may include a multitude of treatment stages separated using plugs or other suitable elements to isolate stages, and that each treatment stage may have a number of perforation clusters. Common design practices include, for example, plug and perf completions or completions with sliding sleeves, and examples according to the present disclosure are applicable to any completion design where it is of interest to measure cluster level flow allocation across multiple fluid entry points from a wellbore into a subsurface formation.

The perforation clusters 122, which pass through both the wellbore casing 110 and the cement 114 between the wellbore casing 110 and the wellbore 102, allow fractures 124 to be created in the formation 104 by pumping pressurized treatment fluid 126 into the wellbore 102, whereafter the pressurized treatment fluid 126 will flow forcibly outward through the perforation clusters 122 and into the formation 104. Fracturing of the formation 104 facilitates the passage of hydrocarbon fluids from the formation 104 into the wellbore 102 after completion of the hydraulic fracturing well 100.

As is also represented in FIG. 1, the outward flow of the pressurized treatment fluid 126 through the perforation clusters 122 creates acoustic emissions 128. These acoustic emissions can be measured to determine flow characteristics of the pressurized treatment fluid 126 passing outwardly through the perforation clusters 122. However, as explained above, installing the necessary optical fiber cable to the hydraulic fracturing well 100 itself has many drawbacks, including cost, required additional components, and scheduling complexities. Additionally, the intensity of the acoustic emissions 128 when emitted as a result of a typical flow of pressurized treatment fluid 126 though the perforation clusters 122 is insufficient for accurate detection and measurement from a remotely located site, such as a monitoring well.

Figure 2:
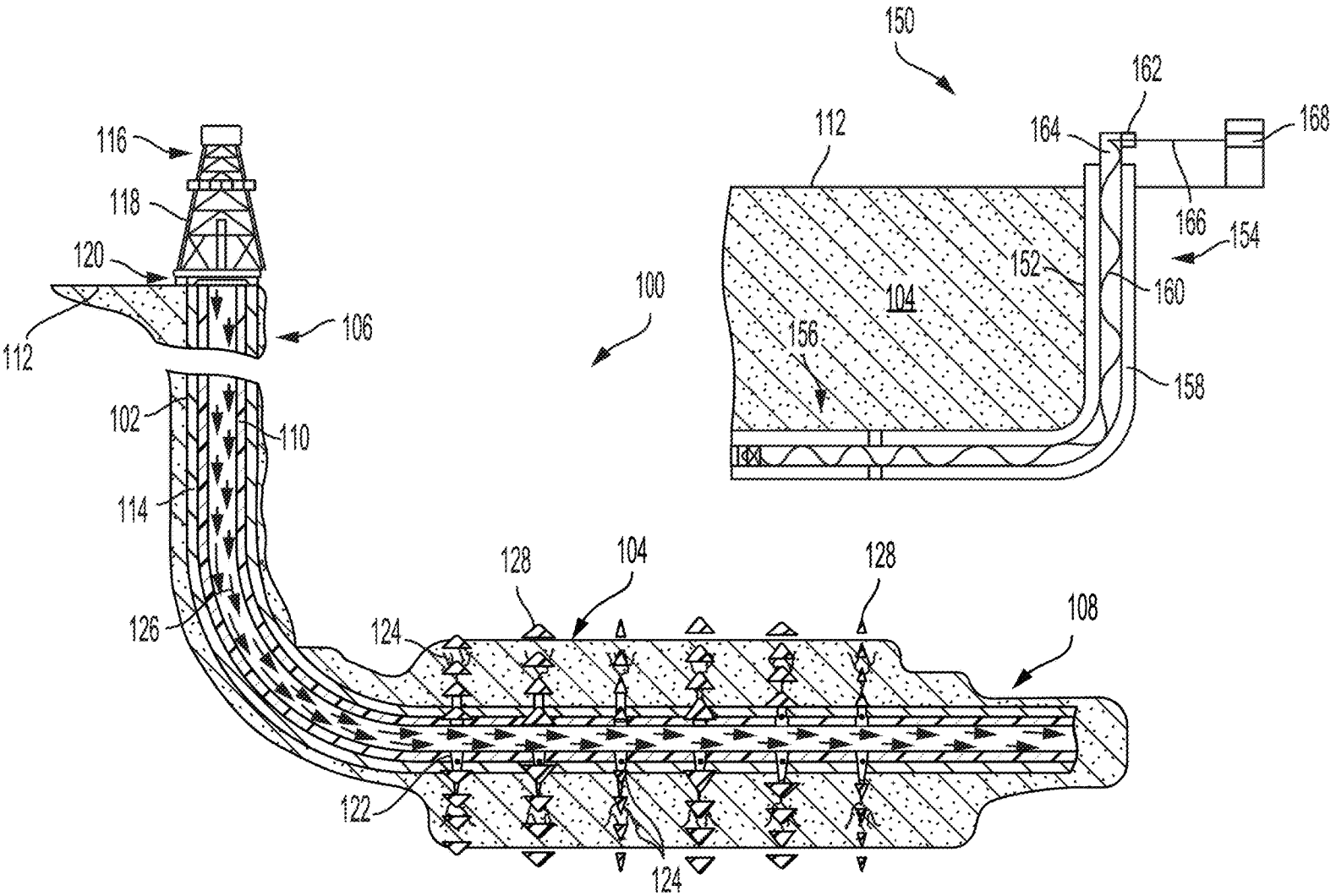
FIG. 2 depicts a system for evaluating the performance of perforation clusters in a wellbore casing of the hydraulic fracturing well of FIG. 1 according to one example of the present disclosure.

A system for evaluating a flow of treatment fluid through the perforation clusters 122 of the hydraulic fracturing well 100 of FIG. 1 from a remotely located monitoring well 150 is represented in FIG. 2. Although the hydraulic fracturing well 100 and the monitoring well 150 appear close together for purposes of illustration in FIG. 2, it is to be understood that the monitoring well 150 may be located at a substantial distance (e.g., hundreds to thousands of feet) from the hydraulic fracturing well 100.

The monitoring well 150 includes a wellbore 152. Like the hydraulic fracturing well 100, this example of the monitoring well 150 includes a vertical wellbore portion 154 and a horizontal wellbore portion 156, as well as a wellbore casing 158. An optical fiber cable 160 is located in the monitoring well 150. The optical fiber cable 160 can be deployed into the monitoring well 150, for example and without limitation, along with a wireline, a slickline or a permanent cable, along with coiled tubing, or by any other suitable technique known in the art. The optical fiber cable 160 may also be deployed into the monitoring well 150 by gravity, pumping, or by pushing or otherwise inserting the optical fiber cable 160 into the monitoring well 150. The optical fiber cable 160 may also be self-propelled using mechanical or chemical propulsion. In another example, the optical fiber cable 160 may instead be affixed to an outside of the wellbore casing 158.

The optical fiber cable 160 can be various types of optical fiber cables. For example, the optical fiber cable 160 may advantageously be a lower cost disposable optical fiber cable, as fluid flow conditions in the monitoring well 150 will not degrade a disposable optical fiber cable in the same manner as the fluid flow conditions in the hydraulic fracturing well 100. Once a disposable fiber has been deployed to a monitoring well, it is also possible for the monitoring well to be made devoid of fluid flow during a monitoring operation.

The optical fiber cable 160 extends, in this example, from a wellhead exit 162 of a tubular, such as a production string or casing 164, above the surface 112 of the formation 104. A surface optical fiber cable 166 can connect the optical fiber cable 160 located in the wellbore casing with a data acquisition device such as an optoelectronic interrogator 168. Together, the optical fiber cable 160 and the optoelectronic interrogator 168 form a distributed optical fiber sensing system such as a distributed acoustic sensing system (DAS). When the intensity of the acoustic emissions 128 produced as the pressurized treatment fluid 126 passes through the perforation clusters 122 of the hydraulic fracturing well 100 is enhanced by other features of a system according to the present disclosure, the DAS can be used to measure the acoustic emissions 128 even though the monitoring well 150 is located remotely from the hydraulic fracturing well 100.

Figure 3:
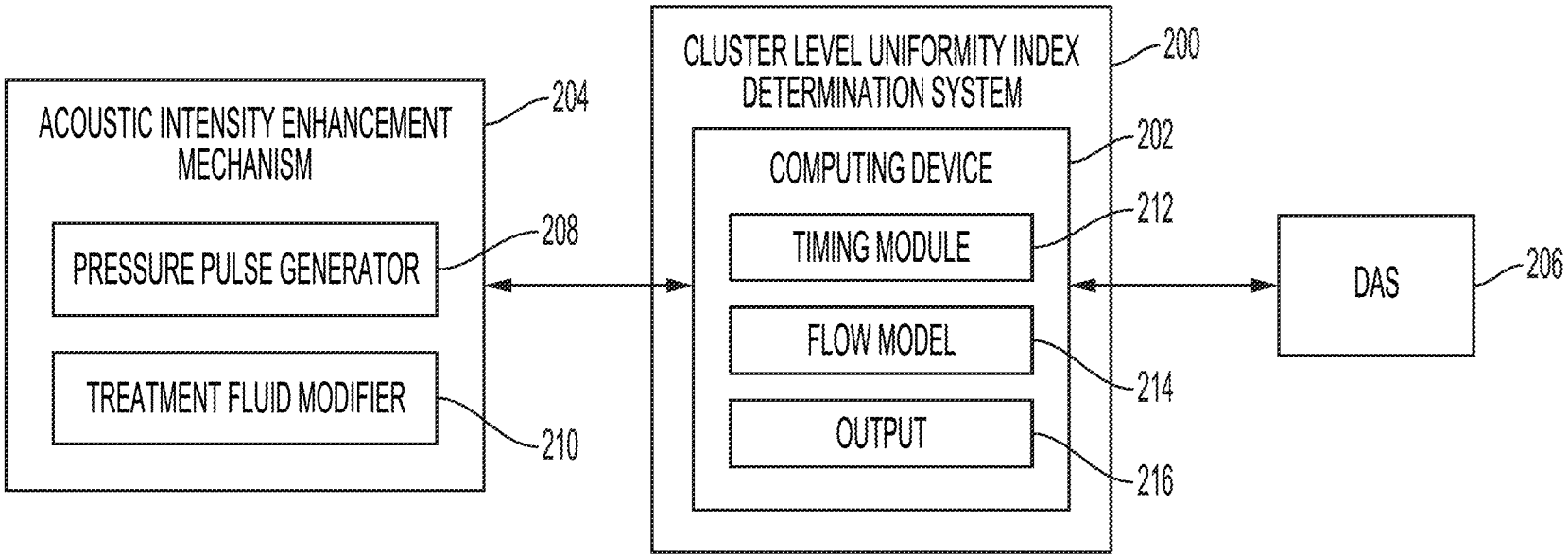
FIG. 3 is a block diagram of a computing environment within which an evaluation of the performance of perforation clusters in a wellbore casing of a hydraulic fracturing well can be accomplished according to one example of the present disclosure.

A computing environment in which can take place operation of a cluster level uniformity index determination system ("system") 200 according to an example of the present disclosure is depicted in FIG. 3. The system 200 is in communication with an acoustic intensity enhancement mechanism 204 associated with a hydraulic fracturing well system, such as but not limited to, the hydraulic fracturing well 100 of FIGS. 1-2. The system 200 is also communicatively coupled to a DAS 206 of a monitoring well, such as but not limited to, a DAS comprising an optical fiber cable and an optoelectronic interrogator as shown in FIG. 2 relative to the monitoring well 150. The hydraulic fracturing well system may also include one or more pumps, blenders, valves, flowlines, etc., associated with fracturing operations.

The system 200 can include a computing device 202. The computing device can receive signals and information from, and send commands to, the acoustic intensity enhancement mechanism 204 associated with the hydraulic fracturing well 100. In this example, the acoustic intensity enhancement mechanism 204 includes a pressure pulse generator 208 and a treatment fluid modifier 210. As described in more detail below, each or both of the pressure pulse generator 208 and the treatment fluid modifier 210 can be used to temporarily enhance (increase) the intensity of the acoustic emissions 128 produced as the pressurized treatment fluid 126 within the hydraulic fracturing well 100 passes through the perforation clusters 122 in the wellbore casing 110. The computing device 202 can also receive signals and data from, and send commands to, the DAS 206 associated with the monitoring well 150.

The computing device 202 may include, for example, a timing module 212 that is operative to ensure that the DAS 206 associated with the monitoring well 150 is listening for and measuring the acoustic emissions 128 emanating from the perforation clusters 122 of the hydraulic fracturing well 100 while the intensity of the acoustic emissions is in a temporarily increased state. The computing device 202 may also include a flow model 214 to which acoustic signal data measured and collected by the DAS 206 relative to the acoustic emissions 128 emanating from the perforation clusters 122 of the hydraulic fracturing well 100 can be provided for conversion into a total flow rate of the treatment fluid 126 flowing outward through the plurality of perforations of the plurality of perforation clusters 122. The computing device 202 may then provide an output 216 of various information or determinations, such as but not limited to the cluster level uniformity index for the hydraulic fracturing well 100, which is an allocation of the total flow of treatment fluid 126 through the perforation clusters 122 on a per cluster basis.

When it is desired to determine the cluster level uniformity index for the hydraulic fracturing well 100, which may be desirable, for example, after completion of a given perforated stage of the wellbore casing 110 and prior to installation or perforation of a next stage, the system 200 can send a command to the acoustic intensity enhancement mechanism 204 to cause the acoustic intensity enhancement mechanism 204 to enhance/increase the intensity of the acoustic emissions 128 associated with the pressurized treatment fluid 126 passing through the already created perforation clusters 122. Enhancement of the intensity of the acoustic emissions 128 associated with the pressurized treatment fluid 126 passing through the already created perforation clusters 122 can be accomplished by activating one or both of the pressure pulse generator 208 and the treatment fluid modifier 210 of the acoustic intensity enhancement mechanism 204. Determination of the cluster level uniformity index may be undertaken at predetermined scheduled times during a hydraulic fracturing operation, may be initiated on demand by an operator, or may be triggered by certain events such as, for example, changes in the fluid flow, pressure set points, proppant concentration, or chemical concentrations during the hydraulic fracturing operation, or by measured pressure changes in the treatment well.

The acoustic emissions produced by a fluid flowing through an orifice like a wellbore casing perforation result from the phenomenon of cavitation. Cavitation occurs when the fluid velocity through an orifice reaches a critical value, which causes the local vapor pressure to drop below the vapor pressure of the fluid, and leads to the formation of vapor bubbles. When these vapor bubbles collapse, pressure waves are created that can be detected as acoustic emissions. The intensity of the acoustic emissions is related to the rate of vapor bubble formation and collapse, which in turn depends on the fluid velocity through the orifice for a given fluid. Therefore, as the fluid velocity increases, the number of bubbles formed and the rate of bubble collapse increases, resulting in a higher intensity of acoustic emissions.

The degree to which a given fluid generally responds to a rapid pressure change depends largely on the compressibility and expandability of the fluid. Consequently, incompressible fluids such as water do not react as strongly to rapid pressure changes as do compressible fluids such as, for example, air, oxygen, nitrogen, helium, hydrogen, carbon dioxide, propane, and other gases. However even incompressible fluids may experience some changes in fluid volume in response to a rapid pressure change.

With this background in mind, it can be understood that the pressure pulse generator 208 of the acoustic intensity enhancement mechanism 204 can enhance the intensity of the acoustic emissions 128 associated with the perforation clusters 122 of the hydraulic fracturing well 100 by introducing a pressure pulse, or a train of pressure pulses, into the treatment fluid 126 traveling through the wellbore casing 110. Such a pressure pulse may be produced by the pressure pulse generator 208 in various ways. For example, a suitable pressure pulse may be generated by closing or changing the position of (choking off) a closeable valve in fluid communication with the pressurized treatment fluid 126 in the wellbore casing 110 of the hydraulic fracturing well 100 to rapidly change the flow rate of the treatment fluid 126 and thereby generate a negative pressure pulse. In another nonlimiting example, the pumping rate of an adjustable flow rate pump used to supply the treatment fluid 126 to the hydraulic fracturing well 100 can be changed to thereby generate a negative or positive pressure pulse. In another nonlimiting example, electrically controlled transducers (e.g., based on piezo ceramics) can be used to create a pressure pulse in the treatment fluid 126. In another nonlimiting example, plasma discharge sources can be used to pass a high amplitude current between electrodes, thereby generating a compressible plasma bubble that will collapse and generate a pressure pulse. In another nonlimiting example, an air gun or a similar device can generate an air bubble of compressible gas that subsequently collapses and generates a positive pressure pulse. In another nonlimiting example, a plunger device may inject a fixed volume of fluid into the flow of treatment fluid 126 to generate a positive pressure pulse. Combinations of these pressure pulse generator mechanisms are also possible.

The use of other mechanisms for generating a pressure pulse in the treatment fluid 126 is also possible. For example, it may be possible to flow back or pump back some amount (e.g., one-half of the wellbore volume) of a clean fluid that has been pumped into the wellbore casing 110 and then pump the clean fluid back into the formation 104 to create pressure differences across the perforations of the perforation clusters to thereby increase cavitation. A pressure pulse may also be generated through use of a combination of pulse generation mechanisms and approaches, all of which are within the scope of the pressure pulse generator 208.

With a goal of rapidly changing the pressure across the perforations of the perforation clusters 122 in the wellbore casing 110 of the hydraulic fracturing well 100, it would be beneficial for the pressure pulse generator 208 to generate a pressure pulse with a large pressure differential. In the case of, for example, choking of a valve by the pressure pulse generator 208 to generate a pressure pulse, creating a sharp initial positive pressure spike in the treatment fluid 126 immediately before choking the valve to produce a negative pressure spike will generate an increased pressure differential. The positive pressure spike may be generated by the pressure pulse generator 208 through, for example, manipulation of the controls of the pump used to supply the pressurized treatment fluid 126 to the hydraulic fracturing well 100, or by utilizing an additive pressure pulse source, such as but not limited to one of the sources described above.

In any case, when a pressure pulse introduced by the pressure pulse generator 208 of the acoustic intensity enhancement mechanism 204 reaches and travels past the location of the perforation clusters 122 the amount of cavitation of the treatment fluid 126 exiting the wellbore casing 110 through the perforation clusters 122 will be increased, which results in acoustic emissions 128 of temporarily increased intensity.

Instead of, or in addition to, enhancing the intensity of the acoustic emissions 128 produced by the treatment fluid 126 exiting the wellbore casing 110 through the perforation clusters 122 by introducing a pressure pulse into the treatment fluid 126, the cavitation and resulting intensity of the acoustic emissions 128 can be increased by using the treatment fluid modifier 210 of the acoustic intensity enhancement mechanism 204 to lower the enthalpy of vaporization of the treatment fluid 126. Lowering the enthalpy of vaporization of the treatment fluid 126 will lead to the formation of more vapor bubbles during cavitation of the treatment fluid 126, which will increase the intensity of the acoustic emissions 128 produced by the treatment fluid 126 when exiting the perforation clusters 122. A lowering the enthalpy of vaporization of the treatment fluid 126 may be performed by the treatment fluid modifier 210, for example, at the beginning and end of a stage when the treatment fluid 126 is proppant free, or continuously during a fracturing operation.

The process of lowering the enthalpy of vaporization of the treatment fluid 126 may be performed on various types of treatment fluids 126, some of which may be more responsive to such an operation than others. For example, and without limitation, fluids such water, ethanol, and chloroform tend to have stronger intermolecular forces and larger molecular size, and thus have higher enthalpy of vaporization values. Contrarily, fluids such a methane, ethylene, and ammonia tend to have weaker intermolecular forces and smaller molecular size, and thus have lower enthalpy of vaporization values.

Lowering the enthalpy of vaporization of the treatment fluid 126 by the treatment fluid modifier 210 may be accomplished in various ways. For example, the treatment fluid modifier 210 may introduce an additive such as but not limited to salt to the treatment fluid 126, which will lower the boiling point and the enthalpy of vaporization of the treatment fluid 126 and increase its cavitation when passing through the perforation clusters 122.

As an alternative to modifying the treatment fluid 126 or another pressurized fluid currently flowing through or otherwise present in the wellbore casing 110, the treatment fluid modifier 210 may operate to temporarily supply a different pressurized fluid to the hydraulic fracturing well 100 during a cluster level uniformity index determination operation. For example, the treatment fluid modifier 210 may replace the pressurized fluid in the wellbore casing 110 with a substitute pressurized fluid that is different than the pressurized fluid. The substitute pressurized fluid may be, for example, methane (natural gas), ethylene, ammonia, or some combination thereof. Natural gas, for example, has an enthalpy of vaporization that is approximately five times lower than water, and would produce an increase in cavitation and acoustic emissions when passing through the perforation clusters 122 of the hydraulic fracturing well 100. Natural gas may also be a produced hydrocarbon, or it may be available for other purposes such as fueling treatment fluid pumps. It may also be possible to use a liquid such as but not limited to brine for a similar purpose.

The treatment fluid modifier 210 may also operate to temporarily substitute other pressurized treatment or non-treatment fluids to the hydraulic fracturing well 100 during a cluster level uniformity index determination operation to reduce vapor pressure and increase fluid cavitation at the perforation clusters 122. For example, a specialized fluid such as a foam with embedded gas bubbles may be used for this purpose, as may a fluid comprising a mixture of fluids and coated solids, a fluid comprising two slugs with different fluids that interact with some time delay via a chemical reaction that changes the fluid properties with time and/or temperature, or a fluid comprising a chemical plug that produces an exothermic reaction to increase downhole temperature around the perforation clusters 122.

Whether the technique of introducing a pressure pulse into the treatment fluid 126 of the hydraulic fracturing well 100 is used alone or in combination with modifying or temporarily replacing the existing pressurized fluid is employed, the resulting enhanced-intensity acoustic emissions 128 can be detected and measured by the DAS 206 at the monitoring well 150 even when the monitoring well 150 is located at a substantial distance from the hydraulic fracturing well 100.

The timing module 212 associated with the computing device 202 of the system 200 can function to ensure that the arrival time of a pressure pulse and/or a modified or substitute fluid at a given perforation cluster of the perforation clusters 122 of the hydraulic fracturing well 100 is substantially known. For example, by knowing the speed at which an introduced pressure pulse travels in the treatment fluid 126 or other fluid flowing within the wellbore casing 110 of the hydraulic fracturing well 100, the timing module can be used to calculate an approximate time of arrival of the pressure pulse at the perforation clusters 122. Similarly, by knowing the flow rate of a modified treatment fluid 126 or the flow rate of a substitute treatment fluid within the wellbore casing 110 of the hydraulic fracturing well 100, the timing module can be used to calculate an approximate time of arrival of the modified treatment fluid 126 or the substitute treatment fluid at the perforation clusters 122. The arrival time of a combination of an introduced pressure pulse and a modified or substitute treatment fluid may also be predicted. In any case, the computing device 202 can alert or instruct the DAS 206 at the monitoring well 150 to listen for the acoustic emissions 128 from the hydraulic fracturing well 100 at and around the predicted time of arrival of a pressure pulse and/or a modified or substitute treatment fluid at the perforation clusters 122. This allows the DAS 206 to monitor for and measure the acoustic emissions 128 from the perforation clusters 122 of the hydraulic fracturing well 100 during a time that the intensity of the acoustic emissions 128 is in an increased state. The pressure pulse generator 208 can also be GPS-synchronized with the DAS 206 for this purpose.

Acoustic emissions data collected by the DAS 206 may be transmitted to the computing device 202 of the system 200 as determined by the system 200, at the request of the computing device 202 of the system 200, or otherwise. The computing device 202 of the system 200 can reside locally to the hydraulic fracturing well 100 and the acoustic intensity enhancement mechanism 204, or may reside locally to the monitoring well 150 and the DAS 206, in which case the computing device 202 may be communicatively coupled to the acoustic intensity enhancement mechanism 204 or the DAS 206 via a local interface. Alternatively, the computing device 202 of the system 200 can reside remotely from the hydraulic fracturing well 100 and the monitoring well 150, and the computing device 202 may receive acoustic emissions data from the DAS 206 over a network. In such a case, the acoustic emissions data may be transmitted from the DAS 206 to the computing device 202 of the system 200 over a network, which may be without limitation, a local area network (LAN), a wide-area network (WAN) such as the Internet, an institutional network, cellular or other wireless networks, etc.

Acoustic emissions measurements made by the DAS 206 relative to the perforation clusters 122 of the hydraulic fracturing well 100 may also be repeated numerous times, and the collective acoustic emissions measurements may be analyzed and compared to filter out unwanted environmental noise. That is, because the acoustic emission signals generated by the passage of the pressurized treatment fluid 126 through the perforation clusters 122 is coherent and repeatable, and environmental noise is random, taking and comparing multiple acoustic emissions measurements allows the environmental noise to cancel out and the coherent acoustic emission signals to become clearer, which effectively improves the signal to noise ratio of the acoustic emission measurements.

Figure 4:
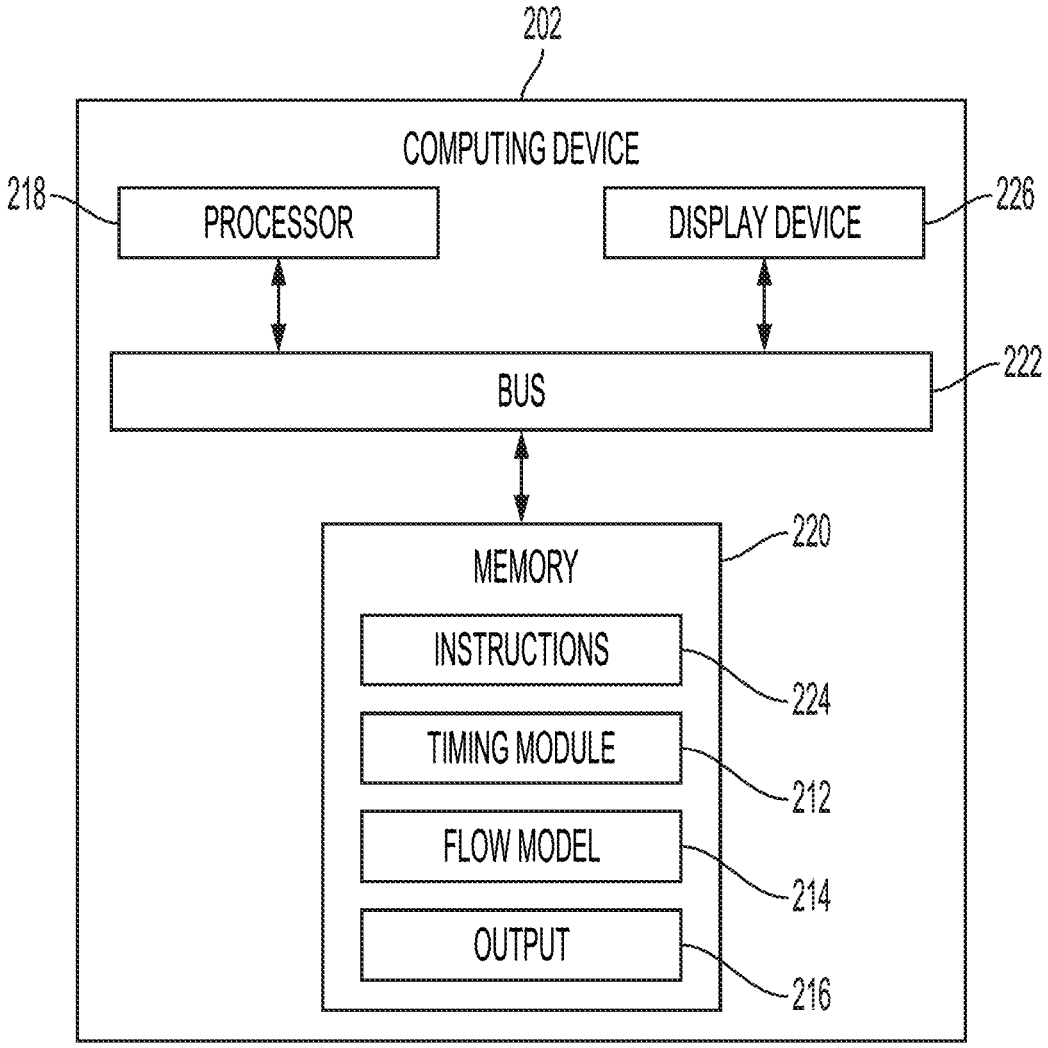
FIG. 4 is a block diagram of a computing system for evaluating the performance of perforation clusters in a wellbore casing of a hydraulic fracturing well according to one example of the present disclosure.

FIG. 4 is a block diagram of an example of the computing device 202 of the system 200, which may be used to determine the cluster level uniformity index of the perforation clusters 122 of the hydraulic fracturing well 100. While FIG. 4 depicts the computing device 202 as including certain components, other examples may involve more, fewer, or different components than are shown in FIG. 4.

As shown, the computing device 202 includes a processor 218 communicatively coupled to a memory 220 by a bus 222. The processor 218 can include one processor or multiple processors. Non-limiting examples of the processor 218 include a Field-Programmable Gate Array (FPGA), an application specific integrated circuit (ASIC), a microprocessor, or any combination of these. Instructions 224 may be stored in the memory 220. The instructions are executable by the processor for causing the processor to perform various operations. In some examples, the instructions 224 can include processor specific instructions generated by a compiler or an interpreter from code written in any suitable computer-programming language, such as C, C++, C#, Java, or Python.

The memory 220 can include one memory device or multiple memory devices. The memory 220 can be non-volatile and may include any type of memory device that retains stored information when powered off. Non-limiting examples of the memory 220 include electrically erasable and programmable read-only memory (EEPROM), flash memory, or any other type of non-volatile memory. At least some of the memory device includes a non-transitory computer-readable medium from which the processor 218 can read instructions 224. A non-transitory computer-readable medium can include electronic, optical, magnetic, or other storage devices capable of providing the processor 218 with the instructions 224 or other program code. Non-limiting examples of a non-transitory computer-readable medium include magnetic disk(s), memory chip(s), ROM, random-access memory (RAM), an ASIC, a configured processor, optical storage, or any other medium from which a computer processor can read the instructions 224.

Through the instructions 224, the computing device 202 may cause the timing module 212 to operate as described above relative to coordinating operation of the DAS 206 with the time of arrival of a pressure pulse and/or a modified or substitute treatment fluid at the perforation clusters 122 of the hydraulic fracturing well 100. The computing device 202 may also execute the flow model 214 on acoustic emissions data received from the DAS 206 to convert the acoustic emissions data into fluid flow information, and may further determine the cluster level uniformity index for the perforation clusters 122 of the hydraulic fracturing well 100 using the determined fluid flow information. The computing device can then provide an output 216 containing various information, including but not limited to the calculated cluster level uniformity index. The output, parts of the output, and/or other information can be presented via various mediums, including on a display device 226 communicatively coupled to the processor 218 by the bus 222.

Figure 5:
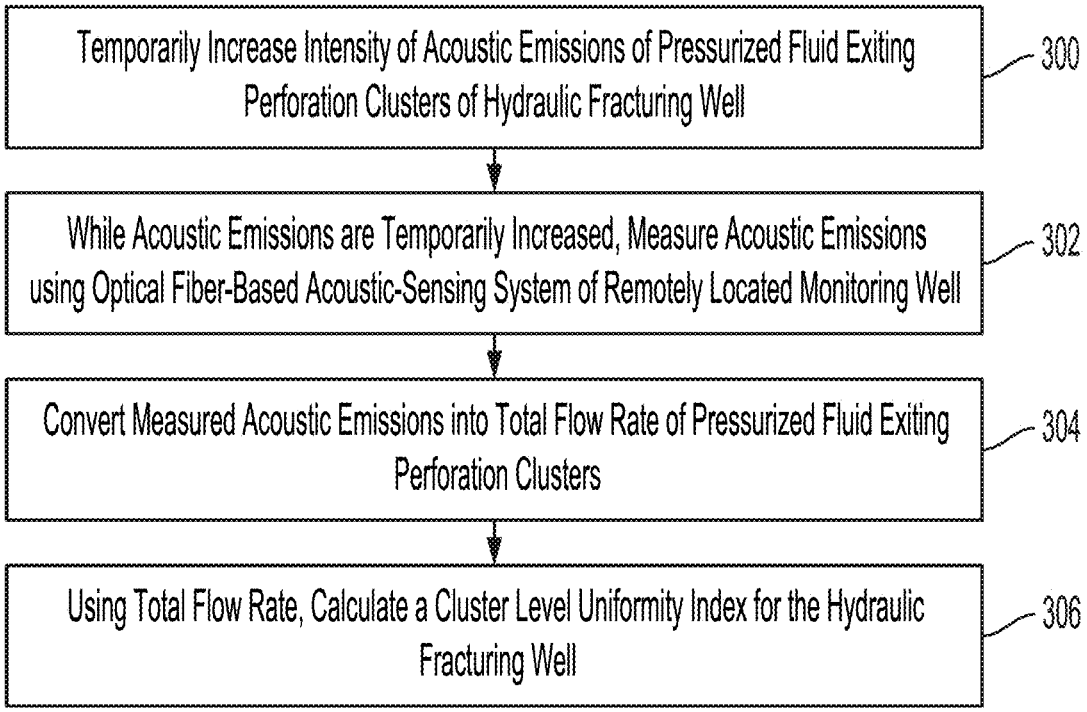
FIG. 5 is a flow chart representing a method for evaluating the performance of perforation clusters in a wellbore casing of a hydraulic fracturing well according to one example of the present disclosure.

FIG. 5 is a flowchart representing a method of determining the cluster level uniformity index for perforation clusters of a hydraulic fracturing well according to one example of the present disclosure. As represented in FIG. 5, at block 300, an intensity of acoustic emissions produced by a pressurized fluid flowing outward through a plurality of perforations of a plurality of perforation clusters in a wellbore casing of a hydraulic fracturing well is temporarily increased by a processor, such as the processor of a cluster level uniformity index determination system. While the intensity of the acoustic emissions is temporarily increased, the acoustic emissions are measured at block 302 by an acoustic sensing system including an optical fiber cable disposed on or in a monitoring well residing in the formation but remotely from the hydraulic fracturing well. At block 304, the acoustic emissions measured by the acoustic sensing system are then converted, by the processor using a flow model, into a total flow rate of the pressurized fluid flowing outward through the plurality of perforations of the plurality of perforation clusters. As indicated at block 306, the processor then calculates, from the total flow rate, a cluster level uniformity index for the hydraulic fracturing well. This information can be used to modify the hydraulic treatment well operation in real-time, or the information can be used to modify future treatment stage designs and/or execution.

For purposes of illustration, examples have been provided herein relative to measuring acoustic emissions produced by pressurized treatment fluid flowing through perforation clusters of a hydraulic fracturing well. It should be understood, however, that the fluid producing the acoustic emissions is not required to be a treatment fluid. For example, and as discussed above, other pressurized fluids, which can include but are not limited to gases, may be pumped into the hydraulic fracturing well and may similarly produce acoustic emissions upon exiting the hydraulic fracturing well through the perforation clusters.

Although not specified above, during measurement of acoustic emissions by the acoustic sensing system, it may be advantage to temporarily reduce or halt the pumping of fluid into wellbore casing of the hydraulic fracturing well, or to at least reduce the pumping rate or the flow rate of the fluid, to minimize or remove flow-related noise than might undesirably be detected by the acoustic sensing system. For example, a valve may be used reduce the pumping rate or the flow rate of the fluid.

According to aspects of the present disclosure, a system, a non-transitory computer-readable medium, and a method, are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a system, comprising: an acoustic sensing system including an optical fiber cable positionable on or in a monitoring well residing in a formation; a processor; and a memory including instructions that are executable by the processor for causing the processor to: in a hydraulic fracturing well located in the formation but remotely from the monitoring well, temporarily increase an intensity of acoustic emissions produced by a pressurized fluid flowing outward through a plurality of perforations of a plurality of perforation clusters in a wellbore casing of the hydraulic fracturing well; measure, by the acoustic sensing system, the acoustic emissions produced by the pressurized fluid flowing outward through the plurality of perforations of the plurality of perforation clusters, while the intensity of the acoustic emissions remains in a temporarily increased state; convert, by a flow model, the acoustic emissions measured by the acoustic sensing system, into a total flow rate of the pressurized fluid flowing outward through the plurality of perforations of the plurality of perforation clusters; and calculate, using the total flow rate, a cluster level uniformity index for the hydraulic fracturing well.

Example 2 is the system of example 1, wherein: the instructions are executable by the processor for causing the processor to temporarily increase the intensity of the acoustic emissions by outputting a command to an acoustic intensity enhancement mechanism to cause the acoustic intensity enhancement mechanism to activate a pressure pulse generator, a treatment fluid modifier, or both; the pressure pulse generator is configured to introduce a pressure pulse into the fluid in the wellbore casing; and the treatment fluid modifier is configured to temporarily replace the pressurized fluid in the wellbore casing with a substitute pressurized fluid that has a lower enthalpy of vaporization than the pressurized fluid, or to modify the pressurized fluid in the wellbore casing by introducing an additive to the pressurized fluid that will reduce the enthalpy of vaporization of the pressurized fluid.

Example 3 is the system of example 2, wherein the pressure pulse generator is selected from the group consisting of a closeable valve in fluid communication with the pressurized fluid in the wellbore casing, an adjustable flow rate pump in fluid communication with the pressurized fluid in the wellbore casing, an electrically controlled transducer in fluid communication with the pressurized fluid in the wellbore casing, a plasma discharge source in fluid communication with the pressurized fluid in the wellbore casing, an air gun in fluid communication with the pressurized fluid in the wellbore casing, a plunger device in fluid communication with the pressurized fluid in the wellbore casing, and combinations thereof.

Example 4 is the system of example(s) 2, wherein the substitute pressurized fluid is selected from the group consisting of methane, ethylene, ammonia, and brine.

Example 5 is the system of example 2, wherein the additive is salt.

Example 6 is the system of example 2, further comprising a timing module useable by the processor to calculate an approximate time of arrival of one or a combination of: the pressure pulse at a given perforation cluster of the plurality of perforation clusters; the modified treatment fluid at a given perforation cluster of the plurality of perforation clusters; and the substitute pressurized fluid at a given perforation cluster of the plurality of perforation clusters.

Example 7 is the system of example 2, wherein the pressure pulse generator is time-synchronized with the acoustic sensing system.

Example 8 is the system of example 1, wherein the acoustic sensing system comprises an optoelectronic interrogator communicatively coupled to the optical fiber cable disposed on or in the monitoring well.

Example 9 is the system of example 1, wherein the optical fiber cable is a disposable optical fiber cable.

Example 10 is the system of example 1, wherein in response to determining that the calculated cluster level uniformity index for the hydraulic fracturing well is unacceptable, the instructions are executable by the processor for further causing the processor to output a control command to cause a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

Example 11 is a computer-implemented method comprising: in a hydraulic fracturing well located in a formation, temporarily increasing, by a processor, an intensity of acoustic emissions produced by a pressurized fluid flowing outward through a plurality of perforations of a plurality of perforation clusters in a wellbore casing of the hydraulic fracturing well; measuring, by an acoustic sensing system including an optical fiber cable positionable on or in a monitoring well residing in the formation but remotely from the hydraulic fracturing well, the acoustic emissions produced by the pressurized fluid flowing through the plurality of perforations of the plurality of perforation clusters, while the intensity of the acoustic emissions remains in a temporarily increased state; converting, by the processor using a flow model, the acoustic emissions measured by the acoustic sensing system, into a total flow rate of the pressurized fluid flowing outward through the plurality of perforations of the plurality of perforation clusters; and calculating, by the processor, from the total flow rate, a cluster level uniformity index for the hydraulic fracturing well.

Example 12 is the computer-implemented method of example 11, wherein: the processor increases the intensity of the acoustic emissions by outputting a command to an acoustic intensity enhancement mechanism that causes the acoustic intensity enhancement mechanism to activate a pressure pulse generator, a treatment fluid modifier, or both; the pressure pulse generator operates by introducing a pressure pulse into the fluid in the wellbore casing; and the treatment fluid modifier operates by temporarily replacing the pressurized fluid in the wellbore casing with a substitute pressurized fluid that has a lower enthalpy of vaporization than the pressurized fluid, or by modifying the pressurized fluid in the wellbore casing by introducing an additive to the pressurized fluid that reduces the enthalpy of vaporization of the pressurized fluid.

Example 13 is the computer-implemented method of example 12, further comprising calculating, by a timing module, an approximate time of arrival of one or a combination of: the pressure pulse at a given perforation cluster of the plurality of perforation clusters; the modified treatment fluid at a given perforation cluster of the plurality of perforation clusters; and the substitute pressurized fluid at a given perforation cluster of the plurality of perforation clusters.

Example 14 is the computer-implemented method of example 12, further comprising outputting, by the processor, a command to the acoustic sensing system that causes the acoustic sensing system to monitor the acoustic emissions at a time of arrival of one or more of the pressure pulse, the modified treatment fluid, or the substitute pressurized fluid, at a given perforation cluster of the plurality of perforation clusters.

Example 15 is the computer-implemented method of example 12, wherein when introducing a pressure pulse into the fluid in the wellbore casing, the pressure pulse generator causes an initial positive or negative pressure spike followed by an opposite-polarity pressure spike to create a pressure pulse with an increased pressure differential.

Example 16 is the computer-implemented method of example 11, wherein in response to determining that the cluster level uniformity index for the hydraulic fracturing well is unacceptable, the processor causes a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

Example 17 is a non-transitory computer-readable medium comprising instructions that are executable by a processor for causing the processor to: in a hydraulic fracturing well located in a formation, temporarily increase an intensity of acoustic emissions produced by a pressurized fluid flowing outward through a plurality of perforations of a plurality of perforation clusters in a wellbore casing of the hydraulic fracturing well; measure, by an acoustic sensing system including an optical fiber cable positionable on or in a monitoring well residing in the formation but remotely from the hydraulic fracturing well, the acoustic emissions produced by the pressurized fluid flowing outward through the plurality of perforations of the plurality of perforation clusters, while the intensity of the acoustic emissions remains in a temporarily increased state; convert, by a flow model, the acoustic emissions measured by the acoustic sensing system, into a total flow rate of the pressurized fluid flowing outward through the plurality of perforations of the plurality of perforation clusters; and calculate, using the total flow rate, a cluster level uniformity index for the hydraulic fracturing well.

Example 18 is the non-transitory computer-readable medium of example 17, wherein: the instructions are executable by the processor for causing the processor to temporarily increase the intensity of the acoustic emissions by outputting a command to an acoustic intensity enhancement mechanism to cause the acoustic intensity enhancement mechanism to activate a pressure pulse generator, a treatment fluid modifier, or both; the pressure pulse generator is configured to introduce a pressure pulse into the fluid in the wellbore casing; and the treatment fluid modifier is configured to temporarily replace the pressurized fluid in the wellbore casing with a substitute pressurized fluid that has a lower enthalpy of vaporization than the pressurized fluid, or to modify the pressurized fluid in the wellbore casing by introducing an additive to the pressurized fluid that will reduce the enthalpy of vaporization of the pressurized fluid.

Example 19 is the non-transitory computer-readable medium of example 18, wherein the instructions are executable by the processor for causing the processor to calculate, by a timing module, an approximate time of arrival of one or a combination of: the pressure pulse at a given perforation cluster of the plurality of perforation clusters; the modified treatment fluid at a given perforation cluster of the plurality of perforation clusters; and the substitute pressurized fluid at a given perforation cluster of the plurality of perforation clusters.

Example 20 is the non-transitory computer-readable medium of example 17, wherein in response to determining that the calculated cluster level uniformity index for the hydraulic fracturing well is unacceptable, the instructions are executable by the processor for further causing the processor to output a control command to cause a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system, comprising:

an acoustic sensing system including an optical fiber cable positionable on or in a monitoring well residing in a formation;

a processor; and a memory including instructions that are executable by the processor for causing the processor to:

in a hydraulic fracturing well located in the formation but remotely from the monitoring well, temporarily increase an intensity of acoustic emissions produced by a pressurized fluid flowing outward through a plurality of perforations of a plurality of perforation clusters in a wellbore casing of the hydraulic fracturing well;

generate, by the acoustic sensing system, acoustic emissions intensity measurements for the acoustic emissions produced by the pressurized fluid flowing outward through each perforation cluster of the plurality of perforation clusters, while the intensity of the acoustic emissions remains in a temporarily increased state;

receive, from the acoustic sensing system, the acoustic emissions intensity measurements;

determine, by a flow model, using the acoustic emissions intensity measurements, a flow rate of the pressurized fluid through each perforation cluster based on a dependence of the acoustic emissions intensity of a given perforation cluster on a velocity at which the pressurized fluid flows outward through the given perforation cluster:

determine a total flow rate of the pressurized fluid flowing outward through the plurality of perforation clusters from the flow rates for the plurality of perforation clusters; and calculate, using the total flow rate and the flow rate of the pressurized fluid through each perforation cluster, a cluster level uniformity index for the hydraulic fracturing well.

2. The system of claim 1, wherein:

the instructions are executable by the processor for causing the processor to temporarily increase the intensity of the acoustic emissions by outputting a command to an acoustic intensity enhancement mechanism to cause the acoustic intensity enhancement mechanism to activate a pressure pulse generator, a treatment fluid modifier, or both;

the pressure pulse generator is configured to introduce a pressure pulse into the fluid in the wellbore casing; and the treatment fluid modifier is configured to temporarily replace the pressurized fluid in the wellbore casing with a substitute pressurized fluid that has a lower enthalpy of vaporization than the pressurized fluid, or to modify the pressurized fluid in the wellbore casing by introducing an additive to the pressurized fluid that will reduce the enthalpy of vaporization of the pressurized fluid.

3. The system of claim 2, wherein the pressure pulse generator is selected from the group consisting of a closeable valve in fluid communication with the pressurized fluid in the wellbore casing, an adjustable flow rate pump in fluid communication with the pressurized fluid in the wellbore casing, an electrically controlled transducer in fluid communication with the pressurized fluid in the wellbore casing, a plasma discharge source in fluid communication with the pressurized fluid in the wellbore casing, an air gun in fluid communication with the pressurized fluid in the wellbore casing, a plunger device in fluid communication with the pressurized fluid in the wellbore casing, and combinations thereof.

4. The system of claim 2, wherein the substitute pressurized fluid is selected from the group consisting of methane, ethylene, ammonia, and brine.

5. The system of claim 2, wherein the additive is salt.

6. The system of claim 2, further comprising a timing module useable by the processor to calculate an approximate time of arrival of one or a combination of:

the pressure pulse at a given perforation cluster of the plurality of perforation clusters;

the modified treatment fluid at a given perforation cluster of the plurality of perforation clusters; and the substitute pressurized fluid at a given perforation cluster of the plurality of perforation clusters.

7. The system of claim 2, wherein the pressure pulse generator is time-synchronized with the acoustic sensing system.

8. The system of claim 1, wherein the acoustic sensing system comprises an optoelectronic interrogator communicatively coupled to the optical fiber cable disposed on or in the monitoring well.

9. The system of claim 1, wherein the optical fiber cable is a disposable optical fiber cable.

10. The system of claim 1, wherein in response to determining that the calculated cluster level uniformity index for the hydraulic fracturing well is unacceptable, the instructions are executable by the processor for further causing the processor to output a control command to cause a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

11. A computer-implemented method comprising:

in a hydraulic fracturing well located in a formation, temporarily increasing, by a processor, an intensity of acoustic emissions produced by a pressurized fluid flowing outward through a plurality of perforations of a plurality of perforation clusters in a wellbore casing of the hydraulic fracturing well;

generating, by an acoustic sensing system including an optical fiber cable positionable on or in a monitoring well residing in the formation but remotely from the hydraulic fracturing well, acoustic emissions intensity measurements for the acoustic emissions produced by the pressurized fluid flowing outward through each perforation cluster of the plurality of perforation clusters, while the intensity of the acoustic emissions remains in a temporarily increased state;

receiving, from the acoustic sensing system, the acoustic emissions intensity measurements;

determining, by the processor executing a flow model, using the acoustic emissions intensity measurements, a flow rate of the pressurized fluid through each perforation cluster based on a dependence of the acoustic emissions intensity of a given perforation cluster on a velocity at which the pressurized fluid flows outward through the given perforation cluster:

determine a total flow rate of the pressurized fluid flowing outward through the plurality of perforation clusters from the flow rates for the plurality of perforation clusters; and calculating, by the processor, from the total flow rate and the flow rate of the pressurized fluid through each perforation cluster, a cluster level uniformity index for the hydraulic fracturing well.

12. The computer-implemented method of claim 11, wherein:

the processor increases the intensity of the acoustic emissions by outputting a command to an acoustic intensity enhancement mechanism that causes the acoustic intensity enhancement mechanism to activate a pressure pulse generator, a treatment fluid modifier, or both;

the pressure pulse generator operates by introducing a pressure pulse into the fluid in the wellbore casing; and the treatment fluid modifier operates by temporarily replacing the pressurized fluid in the wellbore casing with a substitute pressurized fluid that has a lower enthalpy of vaporization than the pressurized fluid, or by modifying the pressurized fluid in the wellbore casing by introducing an additive to the pressurized fluid that reduces the enthalpy of vaporization of the pressurized fluid.

13. The computer-implemented method of claim 12, further comprising calculating, by a timing module, an approximate time of arrival of one or a combination of:

the pressure pulse at a given perforation cluster of the plurality of perforation clusters;

the modified treatment fluid at a given perforation cluster of the plurality of perforation clusters; and the substitute pressurized fluid at a given perforation cluster of the plurality of perforation clusters.

14. The computer-implemented method of claim 12, further comprising outputting, by the processor, a command to the acoustic sensing system that causes the acoustic sensing system to monitor the acoustic emissions at a time of arrival of one or more of the pressure pulse, the modified treatment fluid, or the substitute pressurized fluid, at a given perforation cluster of the plurality of perforation clusters.

15. The computer-implemented method of claim 12, wherein when introducing a pressure pulse into the fluid in the wellbore casing, the pressure pulse generator causes an initial positive or negative pressure spike followed by an opposite-polarity pressure spike to create a pressure pulse with an increased pressure differential.

16. The computer-implemented method of claim 11, wherein in response to determining that the cluster level uniformity index for the hydraulic fracturing well is unacceptable, the processor causes a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

17. A non-transitory computer-readable medium comprising instructions that are executable by a processor for causing the processor to:

in a hydraulic fracturing well located in a formation, temporarily increase an intensity of acoustic emissions produced by a pressurized fluid flowing outward through a plurality of perforations of a plurality of perforation clusters in a wellbore casing of the hydraulic fracturing well;

generate, by an acoustic sensing system including an optical fiber cable positionable on or in a monitoring well residing in the formation but remotely from the hydraulic fracturing well, acoustic emissions intensity measurements for the acoustic emissions produced by the pressurized fluid flowing outward through each perforation cluster of the plurality of perforation clusters, while the intensity of the acoustic emissions remains in a temporarily increased state;

receiving, from the acoustic sensing system, the acoustic emissions intensity measurements;

determining, by a flow model, using the acoustic emissions intensity measurements, a flow rate of the pressurized fluid through each perforation cluster based on a dependence of the acoustic emissions intensity of a given perforation cluster on a velocity at which the pressurized fluid flows outward through the given perforation cluster;

determine a total flow rate of the pressurized fluid flowing outward through the plurality of perforation clusters from the flow rates for the plurality of perforation clusters; and calculate, using the total flow rate and the flow rate of the pressurized fluid through each perforation cluster, a cluster level uniformity index for the hydraulic fracturing well.

18. The non-transitory computer-readable medium of claim 17, wherein:

the instructions are executable by the processor for causing the processor to temporarily increase the intensity of the acoustic emissions by outputting a command to an acoustic intensity enhancement mechanism to cause the acoustic intensity enhancement mechanism to activate a pressure pulse generator, a treatment fluid modifier, or both;

the pressure pulse generator is configured to introduce a pressure pulse into the fluid in the wellbore casing; and the treatment fluid modifier is configured to temporarily replace the pressurized fluid in the wellbore casing with a substitute pressurized fluid that has a lower enthalpy of vaporization than the pressurized fluid, or to modify the pressurized fluid in the wellbore casing by introducing an additive to the pressurized fluid that will reduce the enthalpy of vaporization of the pressurized fluid.

19. The non-transitory computer-readable medium of claim 18, wherein the instructions are executable by the processor for causing the processor to calculate, by a timing module, an approximate time of arrival of one or a combination of:

the pressure pulse at a given perforation cluster of the plurality of perforation clusters;

the modified treatment fluid at a given perforation cluster of the plurality of perforation clusters; and the substitute pressurized fluid at a given perforation cluster of the plurality of perforation clusters.

20. The non-transitory computer-readable medium of claim 17, wherein in response to determining that the calculated cluster level uniformity index for the hydraulic fracturing well is unacceptable, the instructions are executable by the processor for further causing the processor to output a control command to cause a change in a characteristic of the pressurized fluid flowing in the hydraulic fracturing well by initiating an operation on the pressurized fluid selected from the group consisting of adding a diverter material, adjusting a flow rate, adjusting a pressure, adjusting a chemical composition, adjusting a chemical concentration, adjusting a proppant concentration, and combinations thereof.

* * * * *